US008402986B1

(12) United States Patent
Gray

(10) Patent No.: US 8,402,986 B1
(45) Date of Patent: Mar. 26, 2013

(54) DEVICE FOR DEFLATING AND INFLATING AN ITEM

(76) Inventor: Steven S. Gray, Allentown, NJ (US)

( * ) Notice: Subject to any disclaimer, the term of this patent is extended or adjusted under 35 U.S.C. 154(b) by 415 days.

(21) Appl. No.: 12/804,652

(22) Filed: Jul. 27, 2010

(51) Int. Cl.
*A47L 9/02* (2006.01)
*A47L 7/04* (2006.01)
*F16L 37/02* (2006.01)

(52) U.S. Cl. ..... 137/223; 137/625.41; 137/893; 251/340; 251/345; 15/300.1; 15/330; 15/415.1; 15/421

(58) Field of Classification Search ..... 137/223, 137/625.41, 876, 893; 251/340, 345; 15/300.1, 15/330, 405, 415.1, 421
See application file for complete search history.

(56) References Cited

U.S. PATENT DOCUMENTS 159,142 A * 1/1875 Baird ..... 137/893
226,213 A * 4/1880 Van Patten ..... 137/625.41
3,332,101 A * 7/1967 Leinfelt et al. ..... 15/421
3,368,302 A * 2/1968 Martino ..... 137/223
4,043,356 A * 8/1977 Morris et al. ..... 137/223
4,114,230 A 9/1978 MacFarland
4,405,158 A 9/1983 Huberman
5,050,266 A * 9/1991 Schneider ..... 15/421
5,060,339 A 10/1991 Evers
5,746,243 A 5/1998 Franke
5,862,843 A 1/1999 Corbitt, III
6,003,546 A * 12/1999 Thanscheidt ..... 137/223
6,223,764 B1 5/2001 Charlesbois et al.
6,295,693 B1 10/2001 Chou
7,418,763 B2 9/2008 Shaver et al.
7,779,860 B2 * 8/2010 Pears ..... 15/421

* cited by examiner

*Primary Examiner* — John Rivell
(74) *Attorney, Agent, or Firm* — Keene IP Law, LLC

(57) ABSTRACT

A device is provided for deflating or inflating an item using a vacuum source including a receiving member including an outer open-ended cup with a partial bottom, the bottom including a central aperture, and an outer frustoconical portion extending from the central aperture; an air-flow adjusting member including an inner open-ended substantially cylindrical portion, an inner frustoconical portion extending from the inner open-ended substantially cylindrical portion; a tip member; and means for removably coupling the tip member to the air-flow adjusting member.

20 Claims, 7 Drawing Sheets

DEVICE FOR DEFLATING AND INFLATING AN ITEM

FIELD OF THE INVENTION

The invention relates generally to devices for inflating and deflating items, and more particularly, to devices for inflating and deflating an item in conjunction with a vacuum source.

BACKGROUND OF THE INVENTION

Many people have inflatable items, for example, air mattresses, pools, toys and other inflatable items used in pools, rafts, and athletic equipment. The inflatable or air-filled items typically have a valve that must be manually held in an open position to allow air to escape. When removal of air from an air-filled item is warranted, the process can be quite time consuming, and one must remain with the item to keep the valve open. In most cases, a small amount of air still remains in the item, which makes it difficult to fold up for storage, or, due to the air remaining in the item, more storage space is used than necessary.

Conversely, inflating an item may be equally difficult and time consuming, unless one has an air pump/compressor available. Even so, one must remain with the item as it is being inflated, by holding the valve of the inflatable item onto the valve of the motorized air pump or compressor. With the need for an air pump, which can cost between $25 to $60 US dollars, more storage space is required for the additional pump equipment.

Although several devices may be available for inflating and deflating inflatable items, it has been found that the devices are specific to the manufacturer of the vacuum device, and do not necessarily operate with a vacuum source of a different manufacturer. In addition, the hoses of various vacuum sources, such as a household vacuum cleaner, or alternatively, a shop vacuum cleaner, each have different dimensions.

There remains a need for a deflation and inflation device for inflatable items that removes substantially all of the air from an item without the need for a person to remain with the item, or alternatively, a device that quickly inflates an item, each of which operates in conjunction with any hose from numerous vacuum manufacturers regardless of the hose dimensions.

SUMMARY OF THE INVENTION

Briefly described, according to an aspect of the invention, a device for deflating or inflating an item using a vacuum source includes an open-ended top member including a first annular wall, a bottom wall with a central aperture, and a first frustoconical portion extending from the central aperture, the first frustoconical portion including one or more apertures; an open-ended rotatable member including a second annular wall, a second frustoconical portion extending from the second annular wall, the second frustoconical portion including one or more apertures, and a first substantially cylindrical portion extending from the second frustoconical portion, the first substantially cylindrical portion including a coupling mechanism; and an open-ended bottom member including a second substantially cylindrical portion with a mechanism for removably coupling with the coupling mechanism of the open-ended rotatable member, and a tapering portion extending from the second substantially cylindrical portion.

According to another aspect of the invention, a device for deflating or inflating an item using a vacuum source includes a receiving member including an outer annular wall, a bottom portion disposed substantially perpendicular to the outer annular wall, the bottom portion including a central opening, and one or more vent holes disposed between the central opening and the outer annular wall, and an outer frustoconical portion extending from the central opening, the outer frustoconical portion including one or more apertures; an air-flow adjusting member including an inner annular wall, an inner frustoconical portion extending from the inner annular wall, the inner frustoconical portion including one or more apertures, a disk interposed between the inner annular wall and the inner frustoconical portion, the disk including one or more vent holes, and a first coupling mechanism extending from the inner frustoconical portion; and a removable tip member including a second coupling mechanism for removably coupling with the first coupling mechanism, and a tapering portion extending from the coupling mechanism, the tapering portion terminating in an open notch.

According to another aspect of the invention, a device for deflating or inflating an item using a vacuum source includes a receiving member including an outer open-ended cup with a bottom, the bottom including a central aperture and one or more vent holes, and an outer frustoconical portion extending from the central aperture; an air-flow adjusting member including an inner open-ended substantially cylindrical portion, an inner frustoconical portion extending from the inner open-ended substantially cylindrical portion, a disk disposed between the open-ended substantially cylindrical portion and the inner frustoconical portion, the disk including one or more vent holes; a tip member; and means for removably coupling the tip member to the air-flow adjusting member.

BRIEF DESCRIPTION OF THE DRAWINGS

Throughout the drawings, like reference numerals are used to indicate common features of the described devices.

The above-identified drawing figures set forth several preferred embodiments of the invention. Other embodiments are also contemplated, as disclosed herein. The disclosure represents the invention, but is not limited thereby, as it should be understood that numerous other modifications and embodiments may be devised by those skilled in the art which fall within the scope and spirit of the invention as claimed.

DETAILED DESCRIPTION OF THE INVENTION

The terms "a" or "an" as used herein are to describe elements and components of the invention. This is done merely for convenience and to give a general sense of the invention.

The description herein should be read to include one or at least one and the singular also includes the plural unless indicated to the contrary.

The term "comprises", "comprising", "includes", "including", "as", "having", or any other variation thereof, are intended to cover non-exclusive inclusions. For example, a process, method, article or apparatus that comprises a list of elements is not necessarily limited to only those elements but may include other elements not expressly listed or inherent to such process, method, article, or apparatus. In addition, unless expressly stated to the contrary, the term "or" refers to an inclusive "or" and not to an exclusive "or". For example, a condition A or B is satisfied by any one of the following: A is true (or present) and B is false (or not present); A is false (or not present) and B is true (or present); and both A and B are true (or present).

The term "open-ended" means that each end is substantially open to permit the flow of air therethrough.

Figure 1:
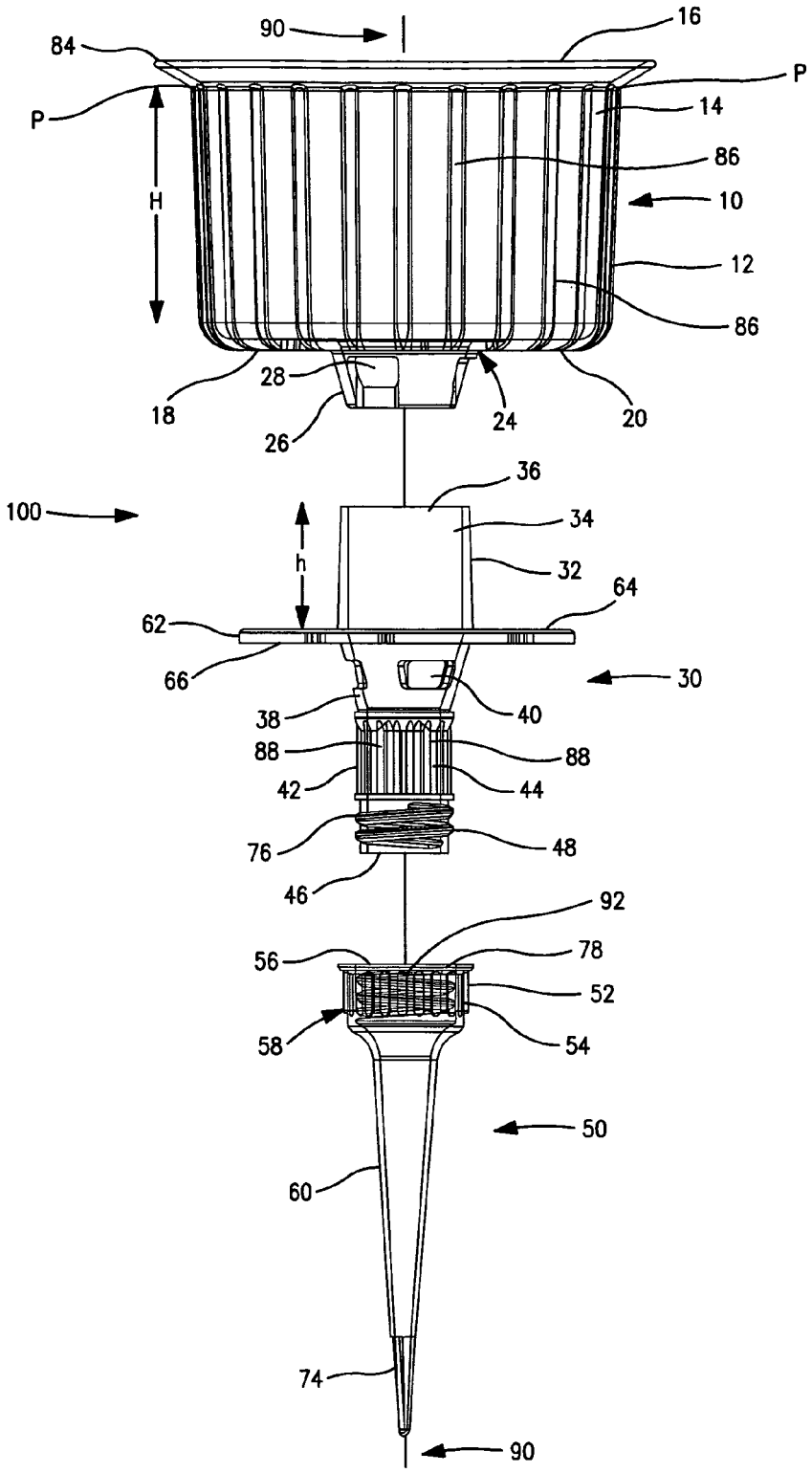
FIG. 1 is an exploded view of the device according to an aspect of the invention.
Figure 4:
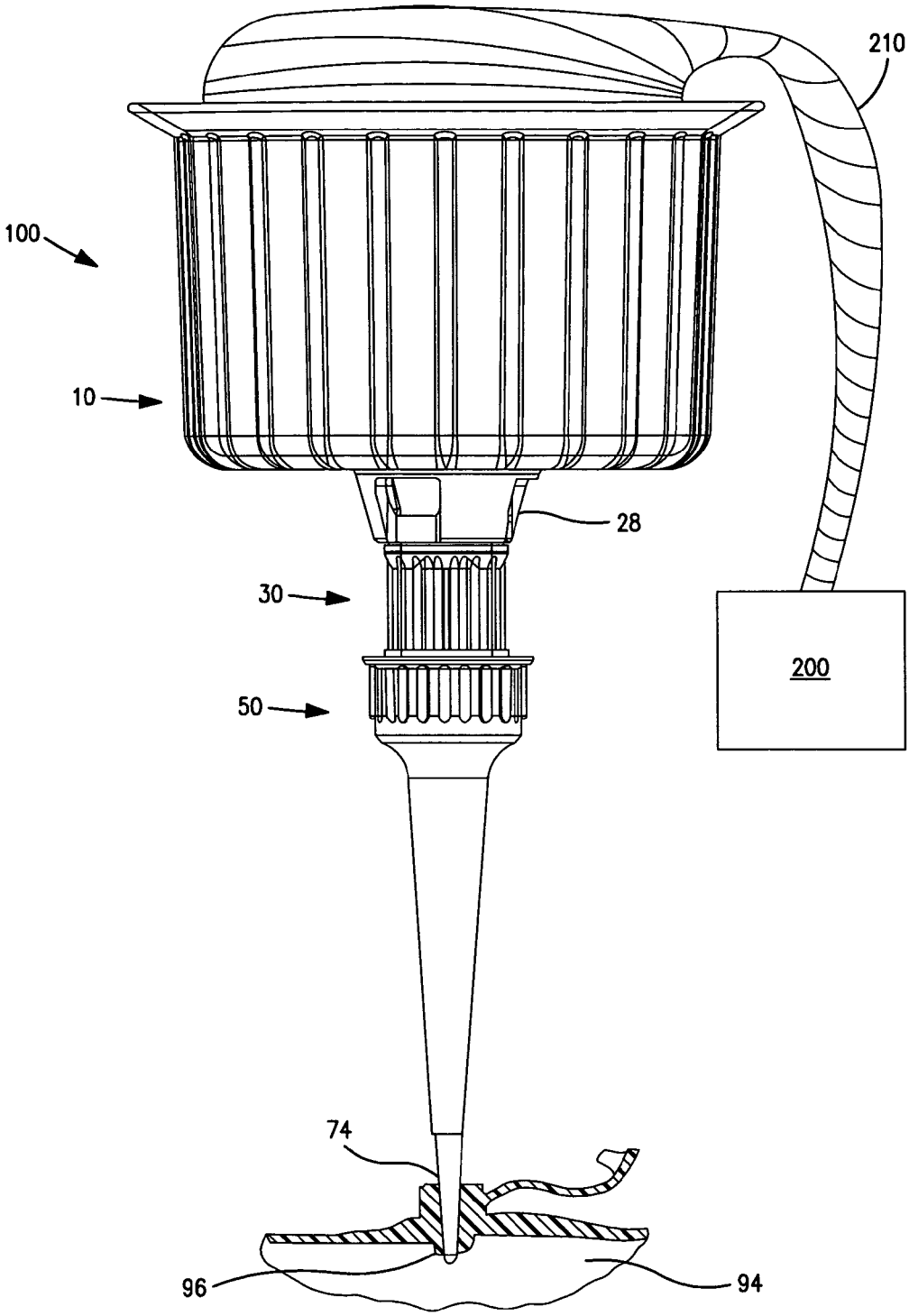
FIG. 4 is a front plan view illustrating the assembled device according to an aspect of the invention.

Referring to FIG. 1, the device 100 according to an aspect of the invention is illustrated. The device 100 may be used for inflating an item 94, or to deflate an item 94 in conjunction with a hose 210 of a vacuum source 200 (FIG. 4), for example, a common household vacuum cleaner, or a larger, shop-vacuum cleaner, which are conventionally equipped with a hose. The hose 210 may be suction-coupled with the device 100 to effect removal of air from an inflated item 94. In the event that inflation of an item 94 is desired, it should be understood that the flow of air through the hose 210 should be reversed, i.e., the hose 210 should be coupled to the outlet of a vacuum source to provide air flow, as opposed to suction.

Figure 2:
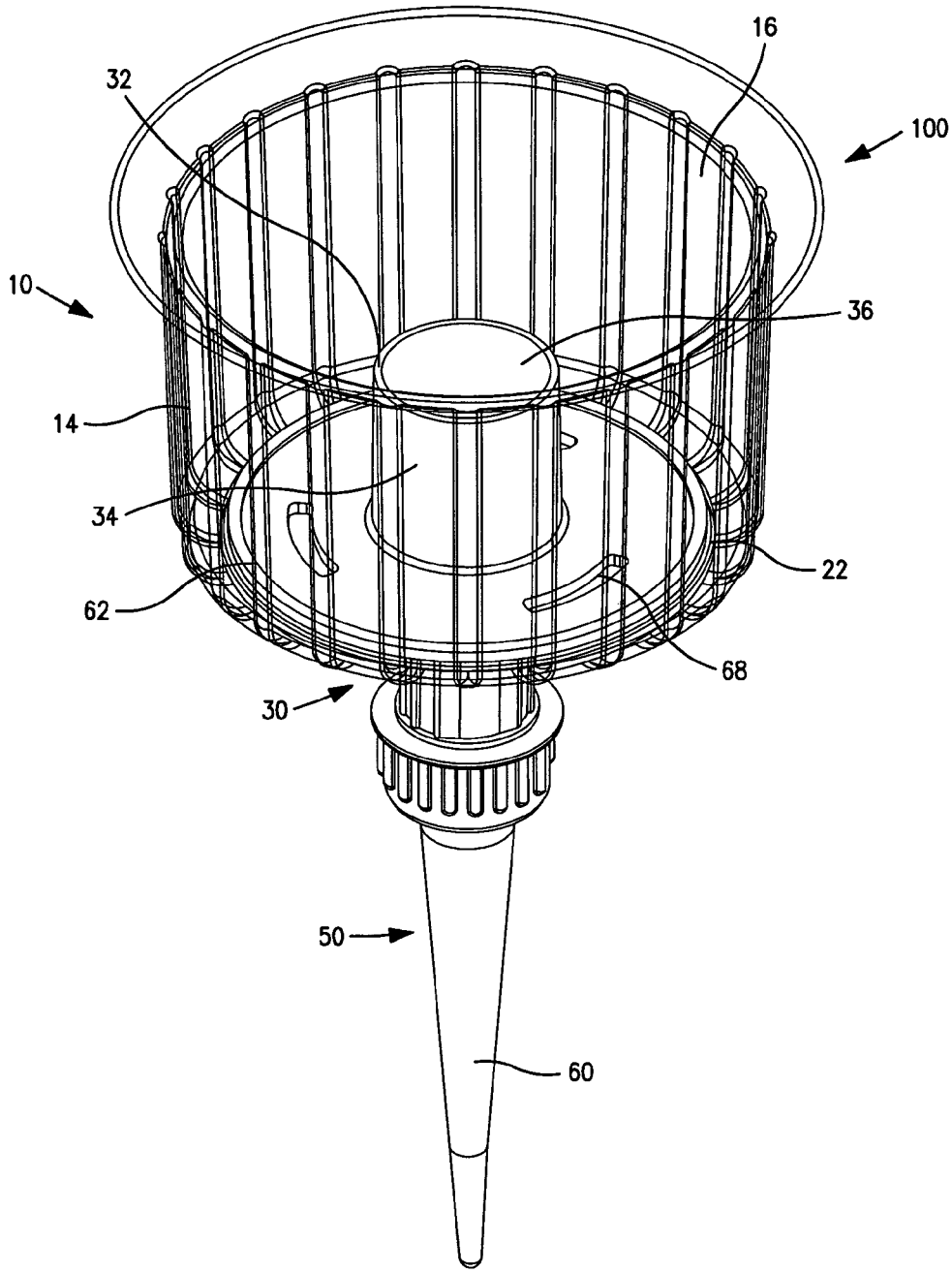
FIG. 2 is a front elevational view illustrating a portion of an outer annular wall of the device in phantom to illustrate the rotatable disk member in context according to an aspect of the invention.

The device 100 includes an open-ended top member 10 for receiving a hose 210 from a vacuum source 200. The open-ended top member 10 includes a first annular wall 12 with an outer surface 14 and an inner surface 16, and a partial bottom wall 18 with an outer surface 20 and an inner surface 22 (FIG. 2). The configuration of the first annular wall 12 and partial bottom wall 18 is similar to that of a cup. The bottom wall 18, disposed substantially perpendicular to the first annular wall 12 and contiguous therewith, includes a central aperture 24. Extending from the central aperture 24 is a first frustoconical portion 26. The first frustoconical portion 26 may include one or more apertures 28.

The device 100 further includes an open-ended rotatable member 30 that is inserted into the open-ended top member 10 upon assembly of the device 100. The open-ended rotatable member 30 includes a second annular wall 32 with an outer surface 34 and an inner surface 36. Extending from the second annular wall 32 is a second frustoconical portion 38. The second frustoconical portion 38 may include one or more apertures 40. The open-ended rotatable member 30 further includes a first substantially cylindrical portion 42 extending from said second frustoconical portion 38. At the distal end of the first substantially cylindrical portion 42, a coupling mechanism 48 is disposed about the perimeter thereof for removably coupling with an open-ended bottom member 50.

The open-ended bottom member 50 includes a second substantially cylindrical portion 52 with a coupling mechanism 58 for removably coupling with the coupling mechanism 48 of the open-ended rotatable member 30, and also includes a tapering portion 60 extending from the second substantially cylindrical portion 52. The tapering portion 60 may terminate in a notch 74.

Figure 3:
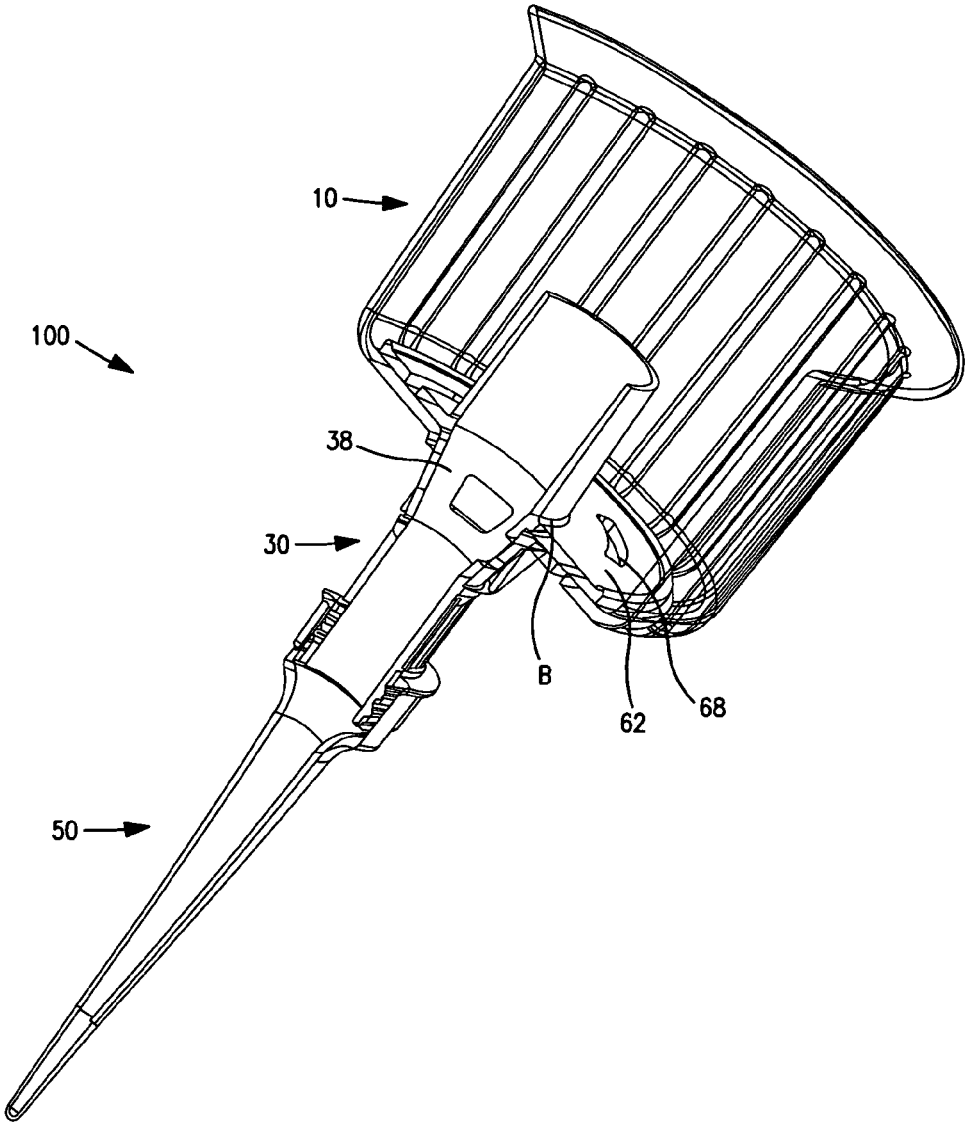
FIG. 3 is a cross-sectional elevational view of the device according to an aspect of the invention.
Figure 6:
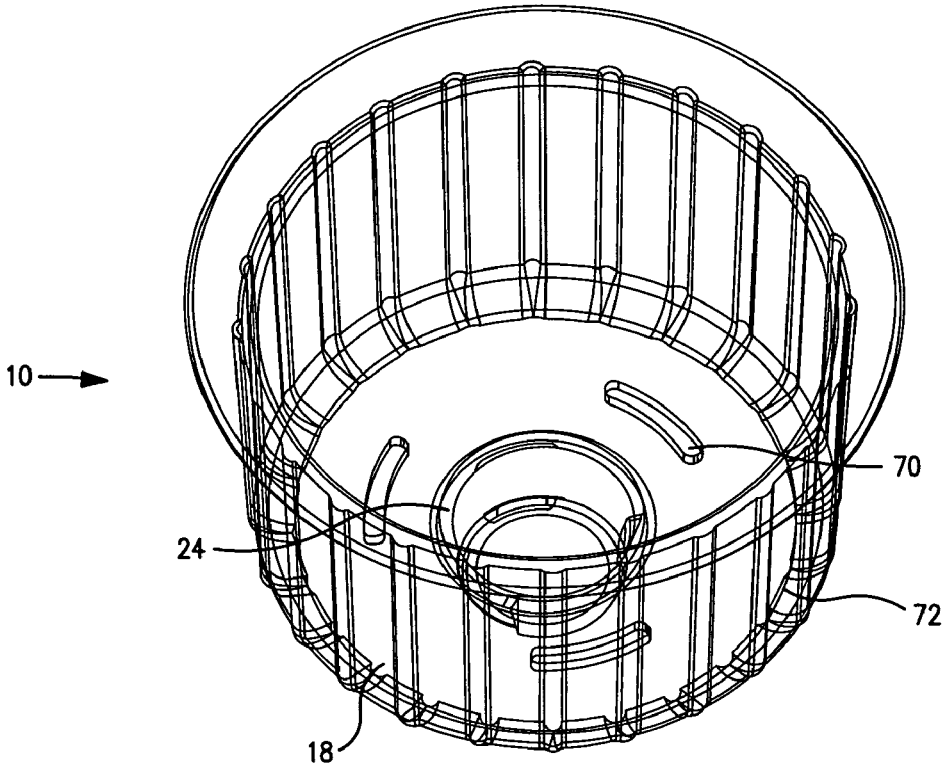
FIG. 6 is a partial phantom view illustrating the open-ended top member of the device according to another aspect of the invention.

As illustrated in FIGS. 2 and 3, the open-ended rotatable member 30 of the device 100 may further include a substantially planar disk 62 interposed between the outer surface 34 of the second inner annular wall 32 and the inner surface 16 of the first annular wall 12. The disk 62 extends radially from the base "B" of the second annular wall 32 to the inner periphery 72 of the bottom wall 18, and may include one or more vent holes 68 that cooperate with one or more vent holes 70 (FIG. 6) in the bottom wall 18 of the device 100 to adjust air flow. Referring now to FIG. 6, according to an aspect of the invention, one or more vent holes 70 may be disposed between the central aperture 24 and the inner periphery 72 of the bottom wall 18 of the open-ended top receiving member 10. The presence of the vent holes 68 and 70 help to direct the flow of air through the substantially hollow device 100. In addition, it has been found that the vent holes 68 and 70 in the disk 62 and the bottom wall 18 of the open-ended member 30 are particularly suited for use with a shop-vacuum cleaner. Although the shape of the vent holes 68 and 70 are illustrated in the general form of a slot, the shape may be circular, or a series of circular apertures, or other suitable geometries may be selected.

Figure 5:
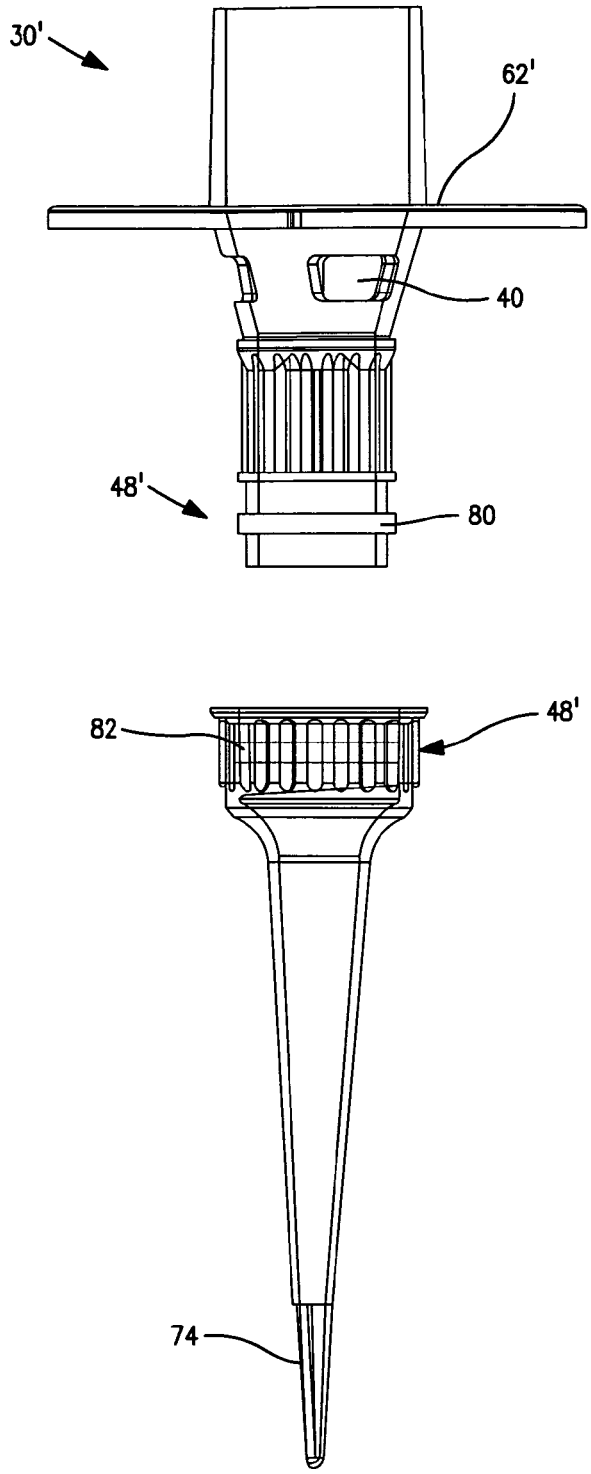
FIG. 5 is a side view illustrating an alternative coupling mechanism and the internal rotatable member of the device according to another aspect of the invention.

Referring back to FIG. 1, the coupling mechanism 48 of the open-ended rotatable member 30 may be a threaded male end 76, and the mechanism 58 of the open-ended bottom member 50 may be a threaded female end 78, as illustrated. Referring to FIG. 5, the coupling mechanism 48' of the open-ended rotatable member 30 may alternatively be a peripheral flange 80, and the mechanism 58 for coupling therewith may be a peripheral groove 82 to provide a snap-fit engagement. It should be understood that other coupling mechanisms may also be suitable.

Referring again to FIG. 1, the first annular wall may include a flange 84 disposed about the perimeter "P" of the first annular wall 12. The outwardly extending flange 84 provides stability to the device 100 so that it does not collapse from the suction force of the vacuum source, and also helps the user grasp the device 100. In addition, the outer surface 14 of the first annular wall 12 may include raised ribs 86 disposed thereon. The raised ribs 86 provide an anti-slip finger grip for ease in placing a hose 210 in the open-ended top receiving member 10. In addition, the outer surface 44 of the first substantially cylindrical portion 42 may include raised ribs 88 disposed thereon. The raised ribs 88 provide an anti-slip finger grip for ease in rotating the open-ended rotatable member 30 of the device 100. Raised ribs 92 may also be provided on the second substantially cylindrical portion 52.

According to another aspect of the invention, as illustrated in FIG. 5, the disk 62' on the open-ended rotatable member 30' does not include vent holes (the bottom wall 18 may or may not include vent holes), but the first and second frustoconical portions 26 and 38 each have apertures 28 and 40 for adjusting or directing the flow of air through the device 100. It has been found that apertures 28 and 40 are particularly suited for use with small or household vacuum cleaners to prevent wear and tear on the motor. It should be noted that when using a shop-vac, and apertures 28 and 40 are present and in an open air-flow position, the apertures will not affect the deflation/inflation process due to the more powerful motor of the shop-vac.

To assemble the device 100, the open-ended rotatable member 30 or 30', which is rotatable to adjust the air flow, is inserted into the open-ended top member 10. Upon assembly, the first annular wall 12 serves as the outer wall, and the second annular wall 32 serves at the inner annular wall of the device. In addition, the first and second frustoconical portions, 26 and 38, serve as the outer and inner frustoconical portions, respectively.

According to an aspect of the invention, the removable bottom tip member 50 may include a notch 74. Advantageously, the removable bottom tip member 50 may be removably coupled to the internal air-flow adjusting member 30 or 30' and replaced with a tip of a different size or length, if needed, depending upon the size of the valve 96 on the inflatable equipment. It should be understood that the tip member be of a particular length, however, to keep an internal flap valve 96 on an inflatable item open for deflation/inflation purposes. Without being limited thereby, an exemplary length for the tip member 50 ranges between about one to four inches. Without being limited thereby, an exemplary length for the notch 74 at the terminal end of the member 50 is approximately ⅛ inch to approximately ½ inch.

Advantageously, upon assembly of the device 100, the open-ended rotatable member inserted into the open-ended top member provides the user with the ability to rotate the rotatable member 360° in either direction about a central axis 90 of the device to adjust air flow to prevent excessive wear on the motor of the vacuum source. For example, when one or more of the vent holes 28 of the first outer frustoconical portion 26 are aligned with one or more of the vent holes 40 of the second inner frustoconical portion 38, the maximum amount of air will pass through. The one or more vent holes 40 of the second inner frustoconical portion 38 may also be rotated so that only a portion of each vent hole 40 is open. In this manner, air flow may be adjusted by rotation of the rotatable member to allow the vent holes 72 on the bottom portion 70, which cooperate with the vent holes 68 in the disk 62 to be closed, partially open, or completely open to the flow of air.

Upon assembly, the second annular wall 32 of the device is lower in height "h" than the height "H" of the first annular wall 12. Advantageously, the presence of the inner annular wall 32 at a lower height provides stability, prevents excessive movement of the hose of the vacuum source, and also helps prevent the hose from being accidentally removed during the deflation or inflation process. The inner annular wall 32 also provides a substantially air-tight fit to prevent air leakage and good suction.

The dimensions and geometric forms of the device 100 presented herein are exemplary. Without being limited thereby, for example, the diameter of the open-ended top receiving member may be approximately two to three inches, which is suitable for receiving most commercially available hoses. The internal annular wall may have about a one to two inch diameter. It should be understood that the open-end of the receiving member 10 be large enough to accommodate most commercially-available hoses, the diameters of household vacuum cleaner hoses having been found to range between about 1¼ to 1¾ inches, and the diameters of shop-vacuum cleaners found to range between about 2 to 2¾% inches.

It has also been advantageously found that a notch 74 disposed at the terminal end of the tip helps to maintain internal flap valves 96 in an open position, but does not operate to puncture or otherwise damage an inflatable item. It should be understood that the device 100 functions regardless of the presence of a notch 74.

The device, according to all aspects of the invention, operates with standard household and shop vacuum cleaners, and obviates the need for an expensive motorized deflator or air pump. In addition, the inner annular wall that provides stability allows a user to couple the device with any vacuum hose with an item for deflating without the need to hold the device or the item with the user's hand.

Figure 7:
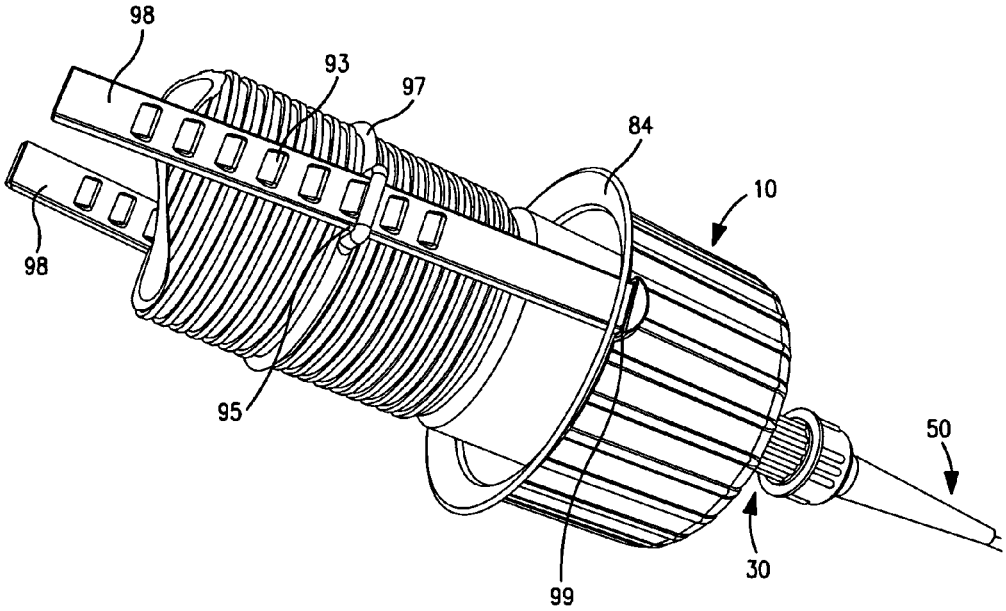
FIG. 7 is an elevational view illustrating an inflation coupling mechanism disposed on the device for inflating items according to another aspect of the invention.

When inflating a device, an additional inflation coupling mechanism may be used to avoid the need for the user's hand to manually hold the device to the vacuum source 200. Referring now to FIG. 7, a elastomeric or rubber o-ring 97 with two or more outer receiving apertures 95 is placed around the hose 210 from the vacuum source 200. The ring 97 is smaller in diameter than the hose, and may be stretched over any hose, whether the hose is smooth or is ribbed. Two straps 98 are received in the outer receiving apertures 95. According to this aspect of the invention, the flange has at least two apertures 99 formed therein, and each end of the straps 98 is inserted into one of the apertures 99 and maintained there with a retaining tab until manually removed. Although not shown, opposite the aperture 99 in FIG. 7 is a second aperture 99, and opposite the outer receiving aperture 95 is a second outer receiving aperture 95. As illustrated in FIG. 7, the straps 98 have notches 93 for adjustment of the ring 97 along the hose. The inflation coupling mechanism is adjustable to all vacuum hoses.

The device provides for rapid inflation and deflation of most items, and removes substantially all the air to allow easier fold-up and storage of the item. For example, inflating (or deflating) an air ring at the top of an 18'×48" inflatable pool using a powerful Sears Shop-Vac may be accomplished in approximately two minutes.

The device may be fabricated from a rigid, lightweight, plastic material, for example, polypropylene, polyethylene, polycarbonate, or other suitable plastic material. It should be understood that the composition of the device is not a limiting factor.

Suitable vacuum sources for use with the present invention include, but are not limited to, the following manufacturers and models: Sears, Shop-Vac, Hoover, Kirby, Eureka, Ridgid, Shark Navigator Bagless Vacuum, Bissell Power Track, Hoover Windtunnel, Bissell Multi Cyclone System, Bissell Healthy Home Vac, Dyson DC 25 VAC, Electrolux Infinity, Hoover Windtunnel Series T, Bissell Power Groom, Dirt Devil, Eureka Enviro Pro, Eureka Pet Pal Vac, Walmart Heavy Duty Series Shop Vac, Lowes Shop Vac, and Sears Craftsman Shop Vac.

The invention has been described with reference to specific embodiments. One of ordinary skill in the art, however, appreciates that various modifications and changes can be made without departing from the scope of the invention as set forth in the claims. Accordingly, the specification is to be regarded in an illustrative manner, rather than with a restrictive view, and all such modifications are intended to be included within the scope of the invention.

Benefits, other advantages, and solutions to problems have been described above with regard to specific embodiments. The benefits, advantages, and solutions to problems, and any element(s) that may cause any benefits, advantages, or solutions to occur or become more pronounced, are not to be construed as a critical, required, or an essential feature or element of any or all of the claims.

What is claimed is:

1. A device for deflating or inflating an item using a vacuum source, the device comprising:

an open-ended top member, comprising:

a first annular wall, a bottom wall with a central aperture, and a first frustoconical portion extending from said central aperture, said first frustoconical portion including one or more apertures;

an open-ended rotatable member, comprising:

a second annular wall, a second frustoconical portion extending from said second annular wall, said second frustoconical portion including one or more apertures, and a first substantially cylindrical portion extending from said second frustoconical portion, said first substantially cylindrical portion including a coupling mechanism; and an open-ended bottom member, comprising:

a second substantially cylindrical portion with a mechanism for removably coupling with said coupling mechanism of said open-ended rotatable member, and a tapering portion extending from said second substantially cylindrical portion.

2. The device according to claim 1, wherein the open-ended rotatable member further comprises a disk disposed between the second annular wall and the second frustoconical portion, said disk including one or more vent holes.

3. The device according to claim 2, wherein the bottom wall of the open-ended top member includes one or more vent holes disposed between the central aperture and a periphery of the bottom wall.

4. The device according to claim 1, wherein the tapering portion terminates in a notch.

5. The device according to claim 1, wherein the coupling mechanism of said open-ended rotatable member is a threaded male end, and the mechanism of said open-ended bottom member is a threaded female end.

6. The device according to claim 1, wherein the coupling mechanism of said open-ended rotatable member is an annular ridge, and the mechanism of said open-ended bottom member is an annular groove.

7. The device according to claim 1, wherein the first annular wall includes a flange about a perimeter of the first annular wall.

8. The device according to claim 1, wherein the first annular wall comprises an outer surface with raised ribs disposed thereon.

9. The device according to claim 1, wherein the first substantially cylindrical portion comprises an outer surface with raised ribs disposed thereon.

10. The device according to claim 1, wherein the second annular wall is lower in height than the first annular wall.

11. The device according to claim 1, wherein the second annular wall is equal in height to the first annular wall.

12. The device according to claim 1, fabricated from a rigid plastic material.

13. The device according to claim 7, further comprising an inflation coupling mechanism for coupling with said flange.

14. A device for deflating or inflating an item using a vacuum source, the device comprising:

a receiving member, comprising:

an outer annular wall, a bottom portion disposed substantially perpendicular to said outer annular wall, said bottom portion including a central opening, and one or more vent holes disposed between said central opening and said outer annular wall, and an outer frustoconical portion extending from said central opening, said outer frustoconical portion including one or more apertures;

an air-flow adjusting member, comprising:

an inner annular wall, an inner frustoconical portion extending from said inner annular wall, said inner frustoconical portion including one or more apertures, a disk interposed between the inner annular wall and the inner frustoconical portion, said disk including one or more vent holes, and a first coupling mechanism extending from said inner frustoconical portion; and a removable tip member, comprising:

a second coupling mechanism for removably coupling with said first coupling mechanism, and a tapering portion extending from said coupling mechanism, said tapering portion terminating in an open notch.

15. The device according to claim 14, wherein the first coupling mechanism of said air-flow adjusting member is a threaded male end, and the second coupling mechanism of said removable tip member is a threaded female end.

16. The device according to claim 14, wherein the outer annular wall includes a flange about a perimeter of the outer annular wall.

17. The device according to claim 14, wherein the outer annular wall comprises an outer surface with raised ribs disposed thereon.

18. The device according to claim 16, further comprising an inflation coupling mechanism for coupling with said flange.

19. A device for deflating or inflating an item using a vacuum source, said device comprising:

a receiving member, comprising:

an outer open-ended cup with a bottom, said bottom including a central aperture and one or more vent holes, and an outer frustoconical portion extending from said central aperture;

an air-flow adjusting member, comprising:

an inner open-ended substantially cylindrical portion, an inner frustoconical portion extending from said inner open-ended substantially cylindrical portion, a disk disposed between said inner open-ended substantially cylindrical portion and said inner frustoconical portion, said disk including one or more vent holes;

a tip member; and means for removably coupling the tip member to the air-flow adjusting member.

20. The device according to claim 19, wherein the tip member terminates in a notch.

* * * * *